US006930443B2

(12) United States Patent
Williamson et al.

(10) Patent No.: US 6,930,443 B2
(45) Date of Patent: Aug. 16, 2005

(54) ARC TUBE/SHROUD HOLDER FOR HID LAMP

(75) Inventors: Glen P. Williamson, Manchester, NH (US); Ebon L. McCullough, New Ipswich, NH (US)

(73) Assignee: Osram Sylvania Inc., Danvers, MA (US)

( * ) Notice: Subject to any disclaimer, the term of this patent is extended or adjusted under 35 U.S.C. 154(b) by 238 days.

(21) Appl. No.: 10/389,322

(22) Filed: Mar. 14, 2003

(65) Prior Publication Data

US 2004/0178715 A1 Sep. 16, 2004

(51) Int. Cl.[7] ..... H01J 5/02; H01J 5/48
(52) U.S. Cl. ..... 313/238; 313/580
(58) Field of Search ..... 313/25, 238, 239, 313/292, 580, 634

(56) References Cited

U.S. PATENT DOCUMENTS 5,075,588 A * 12/1991 Hunter ..... 313/25
5,252,885 A * 10/1993 Muzeroll et al. ..... 313/25
5,594,295 A * 1/1997 Van Gennip et al. ..... 313/25
6,741,013 B2 * 5/2004 Dakin et al. ..... 313/25

* cited by examiner

*Primary Examiner*—Mariceli Santiago
(74) *Attorney, Agent, or Firm*—Carlo S. Bessone

(57) ABSTRACT

A mounting member (50, 50', 50", 50'") for an arc tube/shroud combination comprises an annulus (52). The annulus (52) has at least one mounting tab (54) depending from an outer edge thereof and two spaced apart arc tube-pinch seal-engaging ribs (56, 58) spanning the diameter of the annulus for frictionally engaging the pinch seals. Holding tabs (62) depending from the annulus mount the annulus to a shroud. In a preferred embodiment the ribs (56, 58) have upstanding projections (60) that engage the pinch seals and provide the friction fit necessary for holding the pinch seals.

7 Claims, 4 Drawing Sheets

ARC TUBE/SHROUD HOLDER FOR HID LAMP

TECHNICAL FIELD

This invention relates to lamps and particularly to arc discharge lamps. Still more particularly, the invention relates to arc discharge lamps employing an arc tube, a shield or shroud and mounting means for mounting the arc tube within the shroud.

BACKGROUND ART

Metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. The arc tube, itself hermetically sealed, has tungsten electrodes sealed into opposite ends and contains a fill material including mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud that comprises a generally cylindrical, light-transmissive member, such as quartz, that is able to withstand high operating temperatures. The arc tube and the shroud are coaxially mounted within the lamp envelope with the arc tube located within the shroud. Preferably, the shroud is a tube that is open at both ends. In other cases, the shroud is open on one end and has a domed configuration on the other end. Shrouds for metal halide arc discharge lamps are disclosed in U.S. Pat. No. 4,499,396 issued Feb. 12, 1985 to Fohl et al. and U.S. Pat. No. 4,580,989 issued Apr. 8, 1986 to Fohl et al. See also U.S. Pat. No. 4,281,274 issued Jul. 28, 1981 to Bechard et al.

The shroud has several beneficial effects on lamp operation. In lamps with a gas-filled outer envelope, the shroud reduces convective heat losses from the arc tube and thereby improves the luminous output and the color temperature of the lamp. In lamps with an evacuated outer envelope, the shroud helps to equalize the temperature of the arc tube. In addition, the shroud effectively reduces sodium losses and improves the maintenance of phosphor efficiency in metal halide lamps having a phosphor coating on the inside surface of the outer envelope. Finally, the shroud improves the safety of the lamp by acting as a containment device in the event that the arc tube shatters.

Existing support members that position the arc tube and shroud are quite complex and difficult to fabricate; additionally they are difficult to mount to the arc tube and often cause ergonomic problems for assemblers.

DISCLOSURE OF INVENTION

It is, therefore, an object of the invention to obviate the disadvantages of the prior art.

It is another object of the invention to enhance the assembly of metal halide arc discharge lamps.

These objects are accomplished, in one aspect of the invention by the provision of a mounting member for an arc tube/shroud combination that comprises an annulus, the annulus having at least one mounting tab depending from an outer edge thereof and two spaced apart arc tube-pinch seal-engaging ribs spanning the diameter of said annulus.

These objects are further accomplished by the provision of an arc tube/shroud assembly for an arc discharge lamp that comprises an arc tube having a center portion and opposite pinch seals. A cylindrical shroud surrounds the arc tube and has a mounting member comprised of an annulus mounted at either end. The annulus has at least one mounting tab depending from an outer edge thereof and two spaced apart arc tube-pinch seal-engaging ribs spanning the diameter of said annulus. The pinch-seal engaging ribs frictionally grab the arc tube pinch seals and position the arc tube within the shroud. Nubbins project from the rim of the annulus allowing the arc tube/shroud assembly to be mounted to a frame within a lamp envelope.

Lamps so constructed are simpler to assemble and the mounting members are easier to manufacture and easier to employ, thereby reducing ergonomic problems and reducing the cost of assembly.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
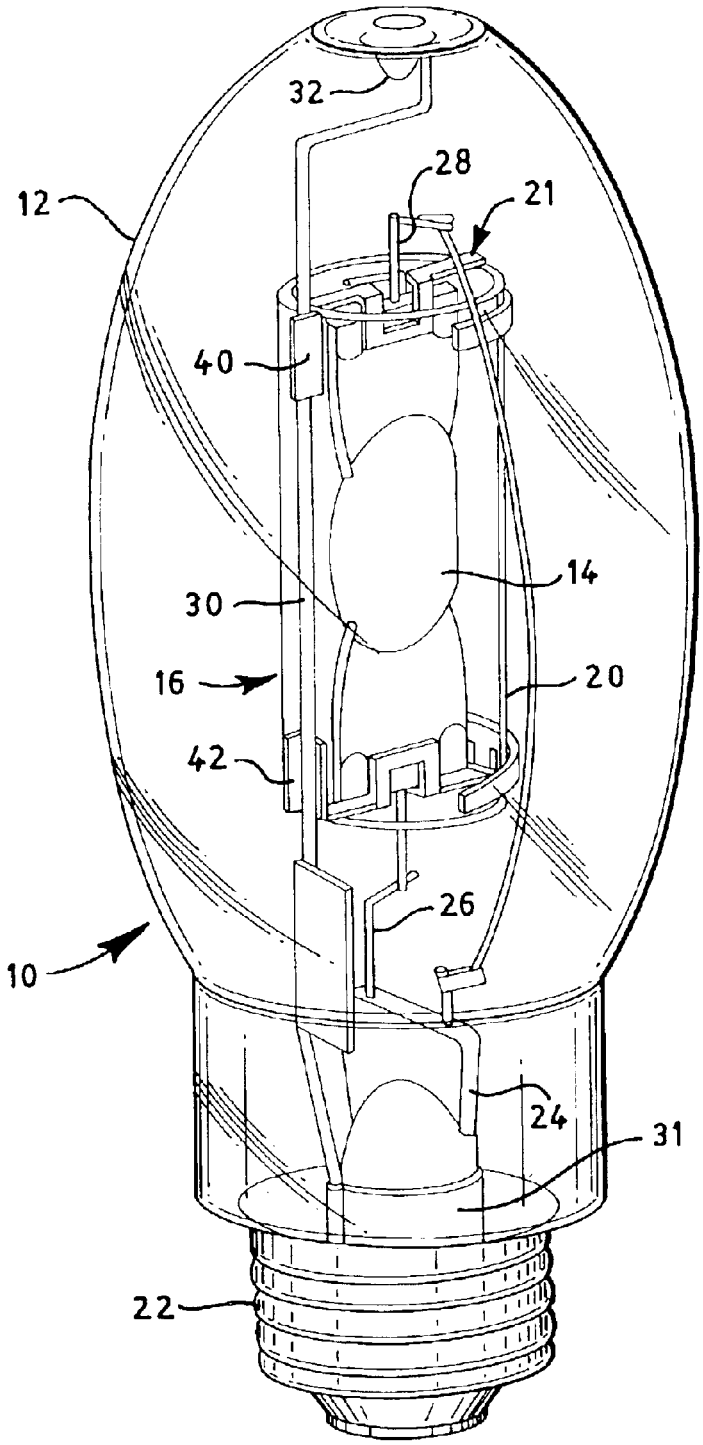
FIG. 1 PRIOR ART
FIG. 1 is a perspective view of a prior art arc discharge lamp embodying a prior mounting member.

Referring now to the drawings with greater particularity, there is shown in FIG. 1 an exemplary metal halide arc discharge lamp 10 employing a prior art mounting member. The discharge lamp 10 is shown as including a lamp envelope 12 and an arc tube 14 mounted within the envelope by mounting frame 16. The arc tube is positioned within a shroud 20 which can also be supported by the mounting frame 16. Electrical energy is coupled to the arc tube 14 through a base 22, a lamp stem 24 and electrical leads 26 and 28. The arc tube contains a chemical fill or dose of materials to provide light when an arc is initiated therein, as is known. The shroud 20 comprises a cylindrical tube of light transmissive, heat resistant material such as quartz.

As noted, in this particular instance, the mounting frame 16 supports both the arc tube 14 and the shroud 20 within the lamp envelope 12 by utilizing mounting members 21. The mounting frame 16 includes a metal support rod 30 attached to lamp stem 24 by a strap 31. The support rod engages an inward projection 32 in the upper end of the lamp envelope 12. The support rod 30 in its central portion is parallel to a central axis of the arc tube 14 and shroud 20. The mounting means 16 further includes an upper clip 40 and a lower clip 42 that are a part of the mounting members 21 and which secure both arc tube 14 and shroud 20 to support rod 30. The clips 40 and 42 are attached to the support rod 30, preferably by welding.

Referring now to FIGS. 3–6 there are shown several embodiments of mounting members 50, 50', 50" and 50'".

Each of the mounting members comprises an annulus 52 having at least one and preferably two mounting tabs 54 depending from an outer edge of the annulus. These mounting tabs are employed for fixing, as by welding, a subsequent assembly to the necessary support rods for positioning the assembly within an envelope. Two spaced apart ribs 56, 58 span the center diameter of the annulus. In the embodiments shown in FIGS. 3, 4 and 6 upstanding projections 60 are provided on the ribs 56 and 58, the tabs extending inwardly toward the center of the annulus and providing a friction fit on the pinch sealed ends of an arc tube. In the embodiment shown in FIG. 5 the tabs 60 are eliminated and the spacing between the ribs 56, 58 provides the necessary friction for mounting. In each of the embodiments the annuli are provided with at least one and preferably two spring-like holding tabs 62 for engaging the sides of the shroud. In a preferred embodiment, the holding tabs 62 are equidistantly spaced between the mounting tabs 54.

Figure 2:
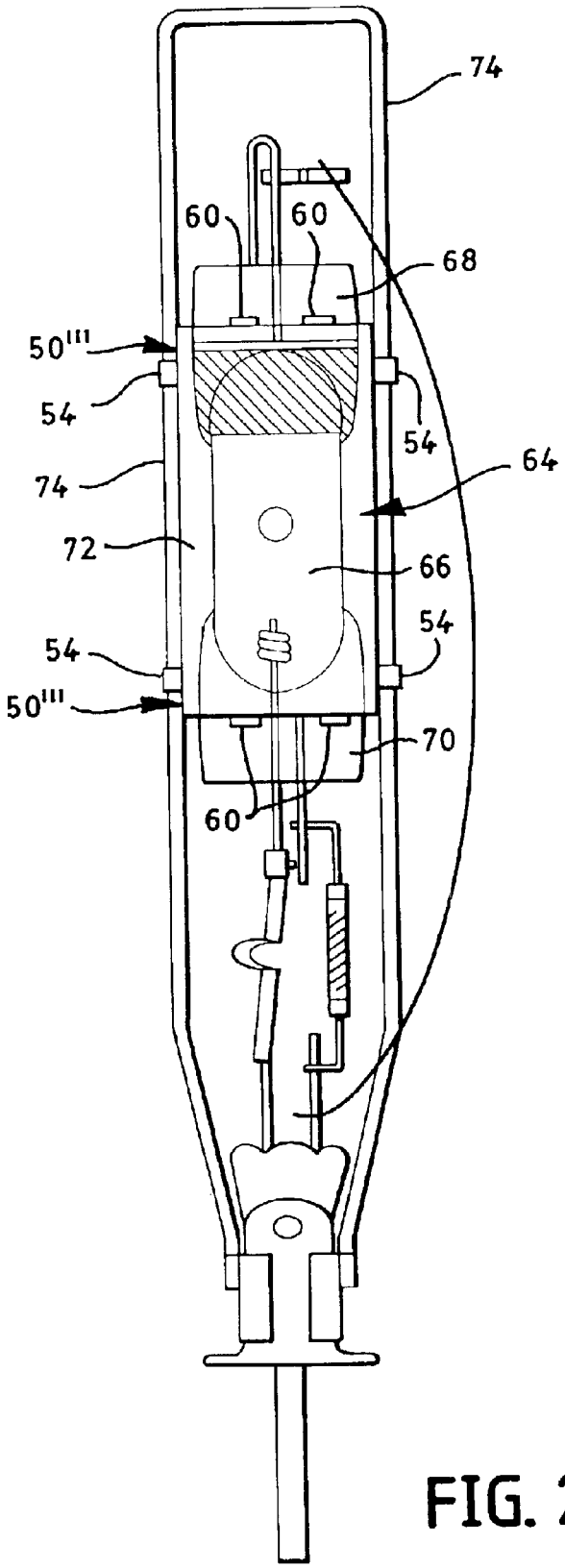
FIG. 2 is an elevational view of an arc tube/shroud assembly utilizing the invention.
Figure 3:
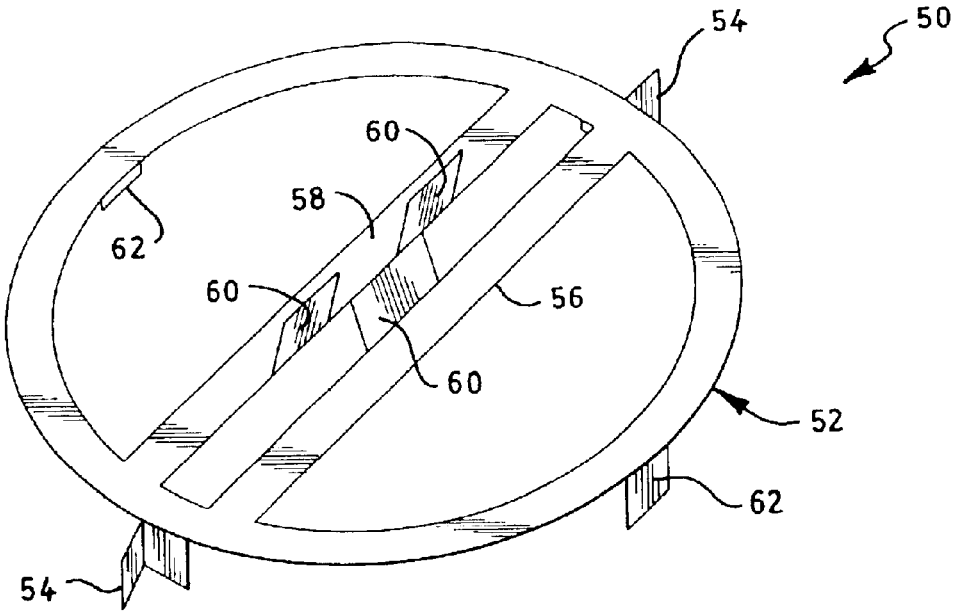
FIG. 3 is a perspective view of an embodiment of a mounting member in accordance with an aspect of the invention.
Figure 4:
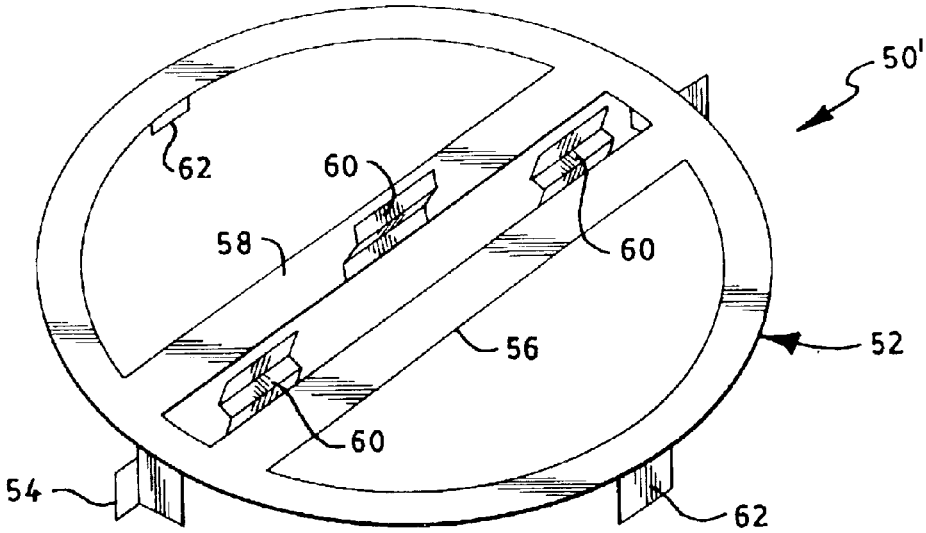
FIG. 4 is a similar view of an alternate embodiment.
Figure 5:
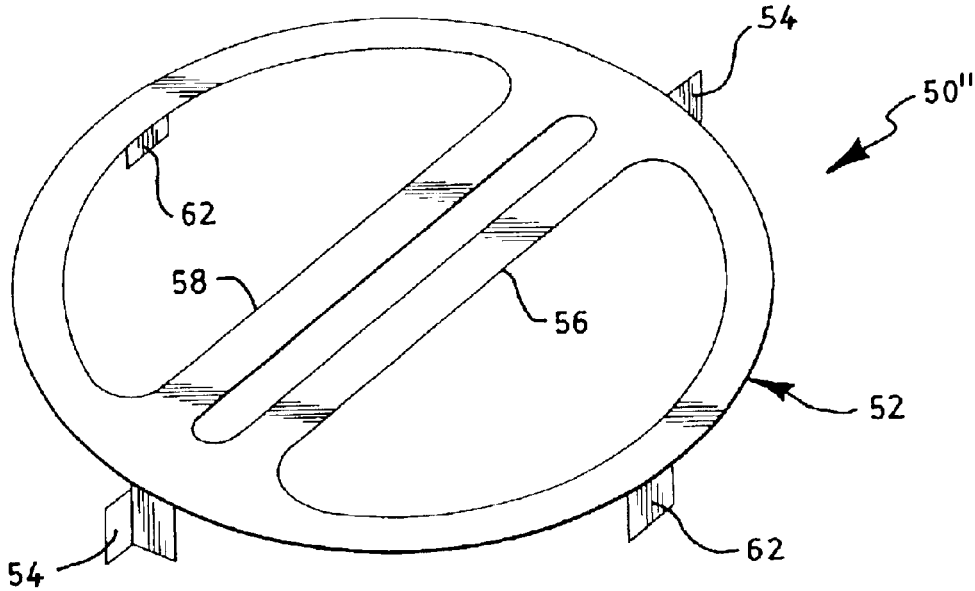
FIG. 5 is a similar view of an additional embodiment.
Figure 6:
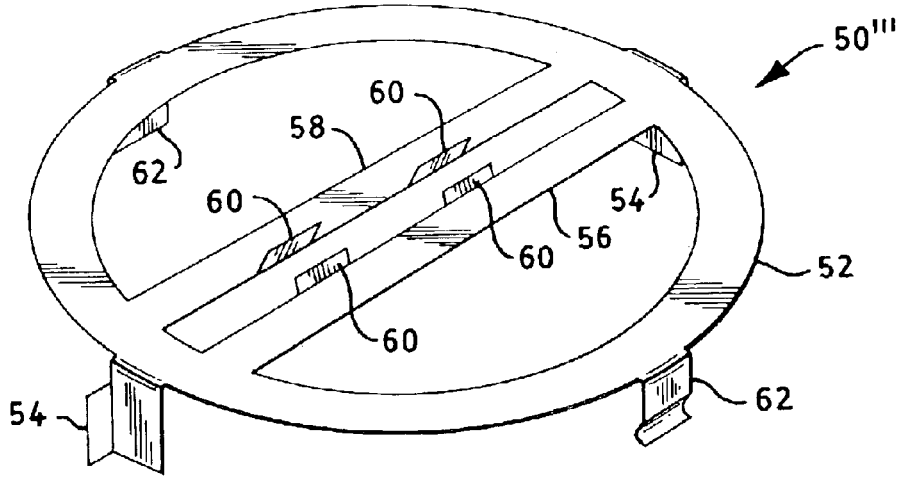
FIG. 6 is a similar view of yet another embodiment

An arc tube/shroud assembly for an arc discharge lamp employing the invention is shown in FIG. 2. Herein an arc tube 64 having a center portion 66 and opposite pinch seals 68, 70 is mounted within a cylindrical shroud 72 by means of a pair of mounting members 50'''. The projections 60 frictionally engage the pinch seals and provide the arc tube/shroud assembly ready for fixation to the support rods 74 by use of the mounting tabs 54. The assembly shown in FIG. 2 utilizes two mounting tabs 54 on each of the annuli; however, if the supporting means shown in FIG. 1 is employed, where a single support rod 30 is used, the annuli need only have one mounting tab 54.

These mounting member provide many advantages over those of the prior art in being simpler to manufacture and easier to use. The ease of use reduces greatly ergonomic problems that may have been associated with prior art techniques.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A single-piece mounting member for an arc tube/shroud combination comprising:

an annulus defining a first plane, said annulus having at least one mounting tab depending from an outer edge thereof and two spaced apart arc tube-pinch seal-engaging ribs spanning the diameter of said annulus, said ribs being planar and integrally formed with said annulus and extending in said first plane.

2. The mounting member of claim 1 wherein one of said ribs is provided with two upstanding projections bent inwardly toward the center of said annulus.

3. The mounting member of claim 2 wherein both of said ribs are provided with two upstanding projections inwardly bent toward the center of the annulus.

4. The mounting member of claim 3 wherein said projections are opposite each other.

5. The mounting member of claim 1 wherein said annulus has two oppositely disposed mounting tabs depending therefrom.

6. The mounting member of claim 5 wherein said annulus has two depending holding tabs positioned substantially midway between said mounting tabs.

7. An arc tube/shroud assembly for an arc discharge lamp comprising:

an arc tube having a center portion and opposite pinch seals;

a shroud surround said arc tube, said shroud being cylindrical; and a pair of single-piece mounting members, one being positioned on each end of said shroud, each single-piece mounting member comprising an annulus defining a first plane, said annulus having at least one mounting tab depending from an outer edge thereof and two spaced apart arc tube-pinch seal-engaging ribs spanning the diameter of said annulus, said ribs being planar and integrally formed with said annulus and extending in said first plane.

* * * * *